United States Patent [19]

Hogeman et al.

[11] 4,178,332

[45] Dec. 11, 1979

[54] CARBURETOR AND METHOD OF CALIBRATION

[75] Inventors: Robert L. Hogeman, Rochester; Jack L. Seaman; Roland S. Taylor, both of Fairport, all of N.Y.

[73] Assignee: General Motors Corporation, Detroit, Mich.

[21] Appl. No.: 916,783

[22] Filed: Jun. 19, 1978

Related U.S. Application Data

[63] Continuation-in-part of Ser. No. 868,713, Jan. 11, 1978, abandoned.

[51] Int. Cl.[2] ..... F02M 7/18

[52] U.S. Cl. ..... 261/50 R; 261/121 B; 261/DIG. 74; 123/119 EC; 251/138; 251/285; 137/595

[58] Field of Search ..... 261/50 R, 121 B, DIG. 74; 123/119 EC, 32 EA, 32 EE; 137/595; 251/129, 285, 138; 137/625.65

[56] References Cited

U.S. PATENT DOCUMENTS

| | | | |
|---|---|---|---|
| 1,197,571 | 9/1916 | Bessom | 261/121 B |
| 2,220,558 | 11/1940 | Van Dijck et al. | 123/198 |
| 2,355,090 | 8/1944 | Love et al. | 261/DIG. 74 |
| 2,369,698 | 2/1945 | Willenberg | 123/119 R |
| 2,747,561 | 5/1956 | Dietrich | 261/DIG. 74 |
| 2,791,995 | 5/1957 | Dietrich | 261/DIG. 74 |
| 2,831,471 | 4/1958 | Schoonover | 261/DIG. 74 |
| 2,981,245 | 4/1961 | Sarto | 261/121 B |
| 2,991,799 | 7/1961 | Littlefield | 137/595 |
| 3,059,909 | 10/1962 | Wise | 261/39 B |
| 3,313,532 | 4/1967 | Carlson et al. | 261/121 B |
| 3,409,277 | 11/1968 | Reise | 261/51 |
| 3,425,672 | 2/1969 | Seigel et al. | 261/121 B |
| 3,454,264 | 7/1969 | Sarto | 261/121 B |
| 3,469,590 | 9/1969 | Barker | 251/129 |
| 3,469,818 | 9/1969 | Cowan | 251/129 |
| 3,529,620 | 9/1970 | Leiber | 251/129 |
| 3,575,390 | 4/1971 | Bickhaus et al. | 261/121 B |
| 3,633,869 | 1/1972 | Lehmann | 251/129 |
| 3,653,642 | 8/1972 | Lawrence | 261/39 B |
| 3,667,722 | 6/1972 | Katz et al. | 251/129 |
| 3,667,739 | 6/1972 | Menke | 261/1 |
| 3,693,947 | 9/1972 | Masaki et al. | 261/39 D |
| 3,703,888 | 11/1972 | Eckert et al. | 123/139 AW |
| 3,706,444 | 12/1972 | Masaki et al. | 261/121 B |
| 3,744,346 | 7/1973 | Miner et al. | 261/69 R |
| 3,745,983 | 7/1973 | Sweeney | 261/50 A |
| 3,827,237 | 8/1964 | Linder et al. | 123/32 EA |
| 3,841,283 | 10/1974 | Wood | 261/DIG. 74 |
| 3,852,383 | 12/1974 | Seaman | 261/69 R |
| 3,855,974 | 12/1974 | Mayer | 123/32 EA |
| 3,859,397 | 1/1975 | Tryon | 261/121 B |
| 3,861,366 | 1/1975 | Masaki et al. | 123/32 EA |
| 3,872,188 | 3/1975 | Brown et al. | 261/121 B |
| 3,874,171 | 4/1975 | Schmidt et al. | 123/32 EA |
| 3,899,552 | 8/1975 | Bauer | 261/DIG. 74 |
| 3,906,910 | 9/1975 | Szlaga et al. | 261/121 B |
| 3,921,612 | 11/1975 | Aono | 123/32 EA |
| 3,933,951 | 1/1976 | Fischer et al. | 261/121 B |
| 3,936,516 | 2/1976 | Nakagawa et al. | 261/121 B |
| 3,939,654 | 2/1976 | Creps | 60/276 |
| 3,942,493 | 3/1976 | Linder et al. | 261/DIG. 74 |
| 3,960,118 | 6/1976 | Konomi et al. | 123/32 EA |
| 3,963,009 | 6/1976 | Mennesson | 123/119 D |
| 3,994,998 | 11/1976 | Mineck | 261/50 A |
| 4,006,718 | 2/1977 | Konomi | 123/32 EA |
| 4,019,470 | 4/1977 | Asano | 123/32 EE |
| 4,019,474 | 4/1977 | Nishimiya et al. | 123/32 EE |
| 4,023,357 | 5/1977 | Masaki | 123/119 EC |
| 4,027,637 | 6/1977 | Ano | 123/119 EC |
| 4,030,292 | 6/1977 | Masaki et al. | 123/119 EC |
| 4,030,462 | 6/1977 | Sasayama et al. | 123/119 EC |
| 4,036,186 | 7/1977 | Hattori et al. | 123/32 EA |
| 4,046,118 | 9/1977 | Aono | 123/119 EC |
| 4,046,165 | 9/1977 | Rose, Sr. et al. | 137/625.6 |
| 4,052,968 | 10/1977 | Hattori et al. | 123/119 EC |
| 4,056,931 | 11/1977 | Hata | 123/119 EC |
| 4,056,932 | 11/1977 | Nakamura et al. | 60/276 |
| 4,057,042 | 11/1977 | Aono | 123/119 EC |
| 4,065,920 | 1/1978 | Minami | 123/119 EC |
| 4,095,570 | 6/1978 | Sheffer et al. | 123/119 EC |
| 4,102,526 | 7/1978 | Hargraves | 137/625.65 |
| 4,108,420 | 8/1978 | West et al. | 251/129 |
| 4,120,481 | 10/1978 | Koch | 251/129 |
| 4,132,199 | 1/1979 | Kuroiwa et al. | 123/119 EC |

FOREIGN PATENT DOCUMENTS

| | | | |
|---|---|---|---|
| 2559079 | 9/1976 | Fed. Rep. of Germany | 261/121 B |
| 2715014 | 12/1977 | Fed. Rep. of Germany | 123/119 EC |

OTHER PUBLICATIONS

SAE Paper, 770,352, 2-28-77, Gantzert et al.
Carter Carburetor Sketches TQ and YF/YFA, (no date).
Rochester Products Bulletin 9D-S, "Quadrajet," G. M. Corp., 10-65.
Research Disclosure, Feb. 1978, p. 19.
Society of Automotive Engineers; Technical Paper 780,204; 2-27-78, Masaki et al.
1976 Oldsmobile Chassis Manual, pp. 6m-35 thru 6m-57, G.M. Corp.
Automotive Engineering, Oct. 1977, p. 38.

*Primary Examiner*—Tim R. Miles

*Attorney, Agent, or Firm*—C. K. Veenstra

[57] ABSTRACT

A carburetor controlled by a pulse width modulated duty cycle operated solenoid has a main metering rod and an idle bleed valve spring biased against a bracket carried by the solenoid armature. The armature is spring biased to a rich position against an adjustable stop and is pulled by the solenoid coil to a lean position against a portion of the solenoid coil assembly. The entire coil assembly is spring biased against a stop which is adjusted to establish the lean position of the metering rod and bleed valve.

5 Claims, 1 Drawing Figure

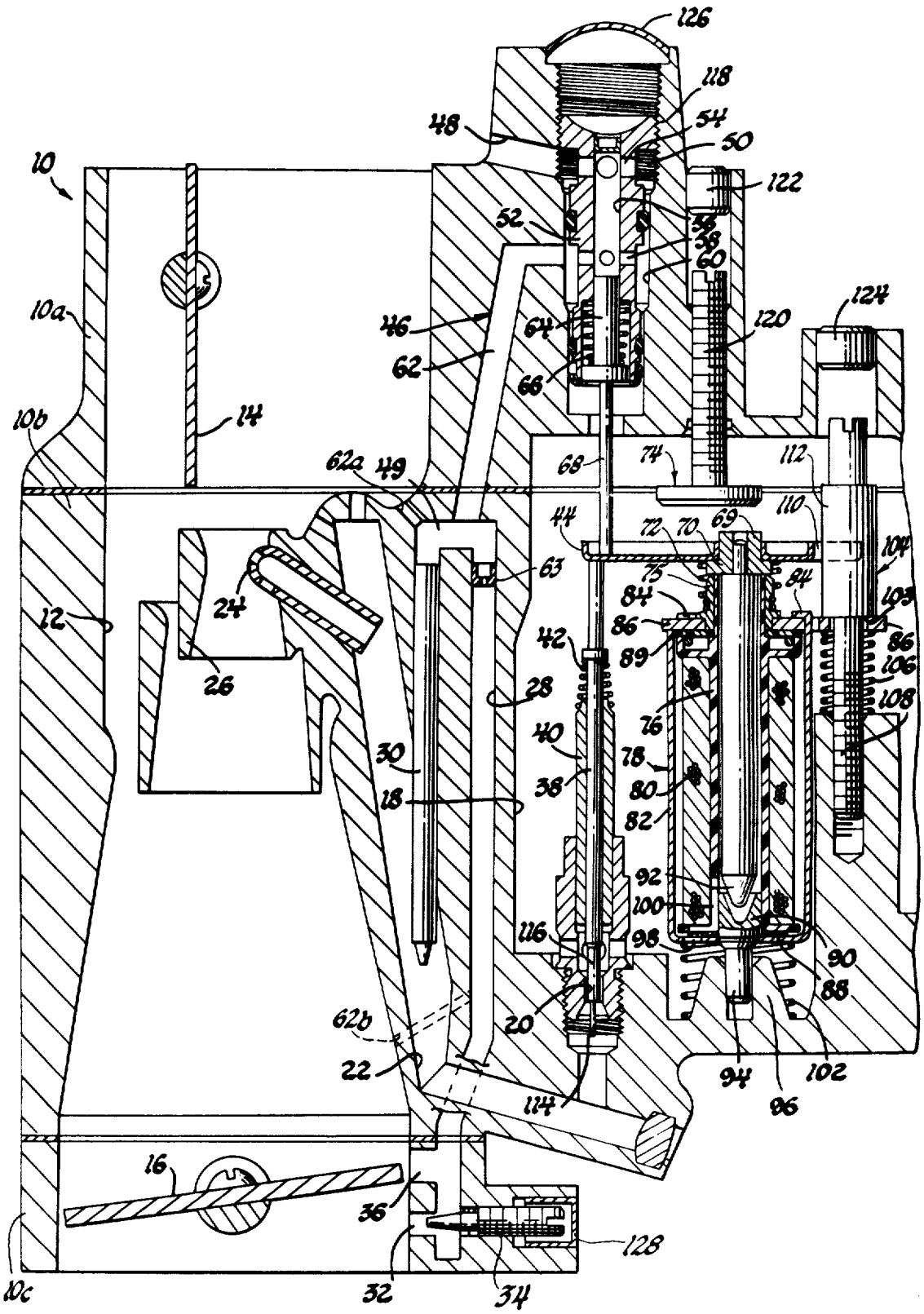
126
118
54
48
50
10
122
52
56
58
60
10a
124
46
64
120
62
66
10b
14
62a
49
68
74
112
44
72
70
69
110
104
63
75
84
84
103
24
12
86
42
89
86
106
26
28
76
108
40
30
78
38
80
18
82
92
100
116
98
90
88
62b
20
22
94
102
114
96
16
36
128
10c
32
34

CARBURETOR AND METHOD OF CALIBRATION

This is a continuation-in-part of application Ser. No. 868,713 filed Jan. 11, 1978, now abandoned.

This invention provides an improved embodiment of the carburetor depicted in copending application Ser. No. 868,712 filed Jan. 11, 1978 in the names of T. J. Atkins, J. D. Cronin and R. L. Hogeman, now abandoned, and relates to a carburetor particularly suitable for operation in a closed loop fuel system and to a method of calibrating such a carburetor.

Several carburetors have been proposed for the purpose of creating an air-fuel mixture of substantially constant (usually stoichiometric) air-fuel ratio for an internal combustion engine. In general, it has been contemplated that such a carburetor would be used in a closed loop system having a sensor—such as a sensor that measures the oxygen content of the engine exhaust gases as an indication of the air-fuel ratio of the mixture created by the carburetor—which would initiate a feedback signal causing the carburetor to create a mixture of the desired air-fuel ratio.

Certain carburetors proposed for that application had metering apparatus controlled indirectly or directly by an electronic device which attempted to maintain the metering apparatus in, or oscillating closely about, the position necessary to create a mixture of the desired air-fuel ratio; rich and lean stops were used primarily to limit open loop travel of the metering apparatus. In other carburetors proposed for that application, however, a device drives the metering apparatus between stops establishing rich and lean positions according to a pulse width modulated duty cycle to maintain the metering apparatus in the lean position for a selected portion of the duty cycle and in the rich position for the remainder of the duty cycle; the carburetor thus pulse width modulates the fuel flow and then averages high and low fuel flows to create a mixture of the desired air-fuel ratio.

This invention provides a carburetor having structure particularly suited for direct pulse width modulation of the fuel flow. In the preferred embodiment of this carburetor, the metering apparatus includes a main metering rod and an idle bleed valve spring biased against a bracket carried by a solenoid armature, and the armature is spring biased to a rich position against an adjustable stop. The solenoid coil is energized according to a pulse width modulated duty cycle to pull the armature away from the rich stop to a lean position against a portion of the solenoid coil assembly for a selected portion of the duty cycle. The entire coil assembly is spring biased against a stop which is adjusted to establish the lean position for the metering apparatus.

The details as well as other features and advantages of this invention are set forth in the following description of a preferred embodiment and are shown in the drawing in which the sole FIGURE is a schematic view of the main and idle metering systems of a carburetor employing this invention.

Referring to the drawing, an internal combustion engine carburetor 10 has an air horn section 10*a*, a fuel bowl section 10*b* and a throttle body section 10*c* which define an air induction passage 12 controlled by a choke 14 and a throttle 16. Within fuel bowl section 10*b*, a fuel bowl 18 delivers fuel through a main metering orifice 20 into a main fuel passage 22 which discharges through a nozzle 24 into a venturi cluster 26 disposed in induction passage 12.

An idle fuel passage 28 has a pick-up tube 30 extending into main fuel passage 22, an idle discharge port 32 opening into induction passage 12 past a threaded adjustable mixture needle 34, and an off-idle port 36 opening into induction passage 12 adjacent throttle 16.

A non-magnetic stainless steel stepped main metering rod 38 is supported in orifice 20 by a non-magnetic stainless steel guide 40 and is biased upwardly by a spring 42 to engage a horizontally disposed stainless steel bracket 44.

In air horn section 10*a*, an idle air bleed passage 46 extends from an inlet 48 to the upper portion 49 of idle fuel passage 28 and includes an annulus 50 about a non-magnetic stainless steel air bleed body 52, upper ports 54, an axial bore 56 and lower ports 58 in air bleed body 52, a second annulus 60 about air bleed body 52, and a lower section 62 opening into idle fuel passage 28 along with a side idle air bleed 62*a* upstream of an idle channel restrictor 63 and a lower idle air bleed 62*b* downstream of restrictor 63. A non-magnetic stainless steel idle bleed valve 64 is disposed in bore 56 to traverse the metering area defined by the opening of lower ports 58 from bore 56 and is biased by a spring 66 so that its tail 68 floats on bracket 44.

Bracket 44 is pressed onto and carried by a non-magnetic stainless steel tip 69 which is pressed onto and forms a part of a nickel plated steel solenoid armature 70. Bracket 44 and armature 70 are biased upwardly by a stainless steel spring 72 to engage tip 69 with the head of a rich stop 74. Spring 72 is retained in an annular recess on a steel sleeve 75.

Armature 70 is received in and guided by a spool 76, molded from 30% glass filled nylon and forming a portion of a solenoid coil assembly 78. A coil 80 is wound on spool 76 and is surrounded by a cupped steel case 82. The upper end of case 82 has three tangs 84 which are bent over a steel end plate 86 into which sleeve 75 is pressed. A domed stainless steel spring washer 88 is disposed between the lower end of spool 76 and the lower end of case 82 to bias spool 76 upwardly toward end plate 86, compressing an insulation washer 89 therebetween.

Solenoid coil assembly 78 has a steel end member 90, pressed into and staked to case 82, which forms a conical air gap with the lower end 92 of armature 70. End member 90 has a projection 94 extending through case 82 and guided in a boss 96 to locate coil assembly 78 within fuel bowl 18.

All steel parts of solenoid coil assembly 78 are zinc dichromated for immersion in fuel bowl 18, and it will be noted that case 82 has a hole 98 and spool 76 has an aperture 100 which permit fuel to circulate within spool 76 about armature 70. Proper operation has been achieved when a fuel filter (not shown) is provided at the carburetor inlet to screen out particles larger than 0.075 mm and the diametral working clearance between spool 76 and armature 70 is between 0.20 and 0.43 mm.

A spring 102 biases solenoid coil assembly 78 upwardly so that end plate 86 engages the shoulder 103 of a lean stop 104. A spring 106 surrounds the threaded stem 108 of lean stop 104 to inhibit changes in the setting of lean stop 104 due to vibration.

Bracket 44 is bifurcated at 110 to surround an extended shank 112 on lean stop 104. Shank 112 thus prevents rotation of armature 70 and bracket 44.

In operation, the metering apparatus (metering rod 38, bracket 44, armature 70 and bleed valve 64) is biased upwardly by springs 42 and 72 to the rich position determined by engagement of armature tip 69 with rich stop 74. In the rich position, the reduced tip 114 of metering rod 38 is disposed in metering orifice 20 to permit increased fuel flow from fuel bowl 18 through metering orifice 20, main fuel passage 22 and nozzle 24 to induction passage 12, while bleed valve 64 obstructs ports 58 to inhibit air flow through bleed passage 46 and thus permit increased fuel flow through idle fuel passage 28 to induction passage 12. When solenoid coil 80 is energized, the metering apparatus is moved to the lean position shown in the drawing, determined by engagement of armature tip 69 with sleeve 75 and established by adjustment of lean stop 104. In the lean position illustrated, the enlarged step 116 of metering rod 38 is disposed in metering orifice 20 to restrict fuel flow from fuel bowl 18 through metering orifice 20, main fuel passage 22 and nozzle 24 to induction passage 12, while bleed valve 64 exposes ports 58 to allow increased air flow through bleed passage 46 into idle fuel passage 28 and thus restrict fuel flow through idle fuel passage 28 to induction passage 12.

It is contemplated that coil 80 will be energized according to a duty cycle of about 10 Hz having a pulse width determined by a sensor measuring the air-fuel ratio of the mixture created by carburetor 10—such as a sensor measuring the oxygen content of the engine exhaust gases—and accordingly will engage armature tip 69 against sleeve 75 for a selected portion of the duty cycle and allow spring 72 to engage armature tip 69 with rich stop 74 for the remainder of the duty cycle; carburetor 10 thus will pulse width modulate the fuel flow and then average high and low fuel flows to create a mixture having a stoichiometric air-fuel ratio or any other desired air-fuel ratio.

Carburetor 10 is calibrated according to the following procedure:

(1) Mixture needle 34, air bleed body 52, rich stop 74 and lean stop 104 are preset to an average setting.

(2) Coil 80 is continuously energized (100% duty cycle), throttle 16 is opened to a part throttle position providing an air flow of, for example, six pounds of air per minute, and lean stop 104 is turned on its threaded stem 108 to establish the lean position of the metering apparatus and thus set the lean part throttle authority for carburetor 10.

(3) Coil 80 is continuously energized (100% duty cycle), throttle 16 is closed to the curb idle position shown in the drawing, and mixture needle 34 is adjusted in port 32 to set the lean idle authority for carburetor 10.

(4) Coil 80 is deenergized (0% duty cycle), throttle 16 is opened to a part throttle position, and rich stop 74 is turned on its threaded stem 120 to establish the rich position for the metering apparatus and thus set the rich part throttle authority for carburetor 10.

(5) Coil 80 is deenergized (0% duty cycle), throttle 16 is closed to the curb idle position, and air bleed body 52 is turned on its threaded shank 118 to adjust the position of body 52 relative to bleed valve 64 and thus set the rich idle authority for carburetor 10.

(6) One or more of the foregoing steps is repeated, other flow points are checked, and plugs 122, 124, 126 and 128 are installed to seal access to adjustable rich and lean stops 74 and 104, air bleed body 52 and mixture needle 34.

Thereafter the carburetor metering apparatus will meter fuel flow between the rich authority and the lean authority when coil 80 is operated at any duty cycle pulse width between 0% and 100%.

It will be appreciated that this invention may be embodied in a two barrel carburetor by addition of another induction passage 12, main fuel passage 22, orifice 20, rod 38, guide 40, idle fuel passage 28, mixture needle 34, and lower idle air bleed section 62; duplication of bracket 44, the solenoid, air bleed body 52 and valve 64, and stops 74 and 104 is not required. Moreover, this invention may be embodied in a multiple stage carburetor by addition of one or more secondary stage induction passages and associated systems of conventional construction.

The embodiments of the invention in which an exclusive property or privilege is claimed are defined as follows:

1. A carburetor comprising a fuel passage, a metering apparatus reciprocable between a rich position and a lean position, said apparatus including a bracket and a metering device biased against and operated by said bracket to restrict fuel flow through said passage in said lean position and to permit increased fuel flow through said passage in said rich position, said apparatus further including a solenoid armature carrying said bracket, a solenoid coil assembly surrounding said armature and energizable for moving said apparatus to one of said positions, and a spring biasing said apparatus to the other of said positions, and wherein the improvement comprises a member included as a portion of said coil assembly and engaged by said armature in said one position, and an adjustable stop controlling the position of said coil assembly for establishing said one position.

2. A carburetor comprising a fuel passage, a metering apparatus reciprocable between a rich position and a lean position, said apparatus including a bracket and a metering device biased against and operated by said bracket to restrict fuel flow through said passage in said lean position and to permit increased fuel flow through said passage in said rich position, said apparatus further including a solenoid armature carrying said bracket, a solenoid coil assembly surrounding said armature and energizable for moving said apparatus to one of said positions, and a spring biasing said apparatus to the other of said positions, and wherein the improvement comprises a member included as a portion of said coil assembly and engaged by said armature in said one position, an adjustable stop, and a spring biasing said coil assembly against said stop for establishing said one position.

3. A carburetor comprising a fuel passage, a metering apparatus reciprocable between a rich position and a lean position, said apparatus including a bracket and a metering device biased against and operated by said bracket to restrict fuel flow through said passage in said lean position and to permit increased fuel flow through said passage in said rich position, said apparatus further including a solenoid armature carrying said bracket, a solenoid coil assembly surrounding said armature and energizable for moving said apparatus to said lean position, and a spring biasing said apparatus to said rich position, and wherein the improvement comprises a member included as a portion of said coil assembly and engaged by said armature in said lean position, an adjustable stop controlling the position of said coil assembly for establishing said lean position, and a rich stop engaged by said armature in said rich position, said rich stop being adjustable for establishing said rich position.

4. A carburetor comprising a fuel bowl, a main fuel passage, a metering orifice opening from said bowl to said passage, an idle fuel passage, an air bleed opening into said idle fuel passage, a metering apparatus reciprocable between a rich position and a lean position, said apparatus including a bracket, a metering rod biased against and operated by said bracket to restrict fuel flow through said passage in said lean position and to permit increased fuel flow through said passage in said rich position, an idle bleed valve biased against and operated by said bracket to restrict air flow through said bleed and thereby permit increased fuel flow through said idle fuel passage in said rich position and to permit increased air flow through said bleed and thereby restrict fuel flow through said idle fuel passage in said lean position, and said apparatus further including a solenoid armature carrying said bracket, a solenoid coil assembly surrounding said armature and energizable for moving said apparatus to said lean position, a spring biasing said apparatus to said rich position, said coil assembly including a member engaged by said armature in said lean position, an adjustable lean stop, a spring biasing said coil assembly against said stop for establishing said lean position, and a rich stop engaged by said armature in said rich position, said rich stop being adjustable for establishing said rich position.

5. The method of calibrating a carburetor having a fuel passage, a metering apparatus reciprocable between a rich position and a lean position and including a bracket and a metering device biased against and operated by said bracket for controlling fuel flow through said passage, said apparatus further including a solenoid armature carrying said bracket and biased to one of said positions, and a solenoid coil assembly surrounding said armature and including a member engaged by said armature in the other of said positions, said method comprising the step of adjusting the position of said coil assembly for establishing said other position.

* * * * *